US011952859B2

(12) United States Patent
Anwar et al.

(10) Patent No.: US 11,952,859 B2
(45) Date of Patent: Apr. 9, 2024

(54) SEALING CRUDE OIL LEAKAGE THROUGH WELLBORE CEMENT FRACTURE USING ELECTROKINESIS

(71) Applicants: Ishtiaque Anwar, Albuquerque, NM (US); Mahmoud Reda Taha, Albuquerque, NM (US); John Stormont, Albuquerque, NM (US)

(72) Inventors: Ishtiaque Anwar, Albuquerque, NM (US); Mahmoud Reda Taha, Albuquerque, NM (US); John Stormont, Albuquerque, NM (US)

(73) Assignee: UNM Rainforest Innovations, Albuquerque, NM (US)

( * ) Notice: Subject to any disclaimer, the term of this patent is extended or adjusted under 35 U.S.C. 154(b) by 0 days.

(21) Appl. No.: 17/623,095

(22) PCT Filed: Jul. 1, 2020

(86) PCT No.: PCT/US2020/040563
§ 371 (c)(1),
(2) Date: Dec. 27, 2021

(87) PCT Pub. No.: WO2021/003307
PCT Pub. Date: Jan. 7, 2021

(65) Prior Publication Data

US 2022/0268125 A1 Aug. 25, 2022

Related U.S. Application Data

(60) Provisional application No. 62/869,504, filed on Jul. 1, 2019.

(51) Int. Cl.
*E21B 33/13* (2006.01)

(52) U.S. Cl.
CPC ..... *E21B 33/13* (2013.01)

(58) Field of Classification Search
None
See application file for complete search history.

(56) References Cited

U.S. PATENT DOCUMENTS 2,283,206 A * 5/1942 Hayward ..... E21B 47/113 166/371
3,411,579 A * 11/1968 Kolaian ..... E21B 33/14 204/515
4,950,374 A * 8/1990 Darilek ..... C25D 13/22 204/490

(Continued)

FOREIGN PATENT DOCUMENTS

RU 2103054 C1 1/1998

OTHER PUBLICATIONS

Nemecek et al.; Electrokinetic nanoparticle injection for remediating leaks in oil well cement; 2017; Elsevier; pp. 63-72 (Year: 2017).*

(Continued)

*Primary Examiner* — Anuradha Ahuja
(74) *Attorney, Agent, or Firm* — Keith Vogt, Ltd.; Keith A. Vogt

(57) ABSTRACT

The present invention provides a method of repairing one or more fractures in a wellbore cement by an electric field to move micelles from crude oil to the area to be repaired.

11 Claims, 5 Drawing Sheets

(56) References Cited

U.S. PATENT DOCUMENTS 5,165,478 A * 11/1992 Wilson ..... E21B 29/00
166/241.1
2015/0167439 A1* 6/2015 Kasevich ..... E21B 43/168
166/248

OTHER PUBLICATIONS

Zhilenkov et al; On some features of electroosmotic filtration in clay soils, Collection of "Izvestia VNIIG im. B.E. Vedeneev", vol. 242, "Foundations, soil and underground structures in St. Petersburg, JSC "VNIIG im. B.E. Vedeneeva"", St. Petersburg, 2003; RU.

* cited by examiner

SEALING CRUDE OIL LEAKAGE THROUGH WELLBORE CEMENT FRACTURE USING ELECTROKINESIS

RELATED APPLICATIONS

This application is a 371 U.S. National Phase of PCT/US2020/040563 filed on Jul. 1, 2020, which claims priority to U.S. Provisional Application Ser. No. 62/869,504 filed on Jul. 1, 2019, both of which are incorporated herein in their entirety.

BACKGROUND OF THE INVENTION

Wellbores are used to provide subsurface access for a wide range of operations, including fluid storage, waste disposal, and oil/gas exploration/production. Typically, wellbores consist of steel casing surrounded by a cement sheath that creates a seal in the annular space between the host rock and casing. The integrity of cement, which is usually Portland Class G, API rating can be less than intended due to several factors, such as poor workmanship, the harsh chemical environment from stored fluids, geomechanical stress from the adjacent formation, cavern pressure, shrinkage during hydration, etc. Consequently, leakage of liquid through cement fractures is possible in a wellbore system.

Crude oils, which are a complex mixture of a variety of chemical compounds, can leak upward through wellbore flaws, such as cement fractures, and can contaminate water-bearing formations. Overall, this can substantially compromise the functionality of the wellbore.

Modified Portland cement, polymer-based compounds, and swelling technologies have been used as primary sealants in wells throughout the world. But these materials have limitations and consequently are not always effective. A principal limitation of cementitious material is that it is not effective in small aperture fractures. It has been shown that the minimum fracture aperture of about 48 μm (3×d95) could be effectively sealed using cement-based repair material. Moreover, the current approaches might not be both effective and economically feasible for rough fractures that have substantially smaller apertures due to lower penetrability, which can still serve as a fluid leakage pathway. Moreover, multiple smaller aperture fractures can collectively act as a significant leakage path, necessitating a more suitable approach to sealing.

BRIEF SUMMARY OF THE INVENTION

In one embodiment, the present invention provides a method, system, and device for sealing a wellbore or piping system by creating a zone or area of voltage difference above and below a leak.

In one embodiment, the present invention provides a method, system, and device for sealing a wellbore or piping system by creating a zone or area voltage difference above and below a leak in the wellbore or piping system that uses electrokinesis for sealing fractures.

In other embodiments, the present invention provides a method, system, and device for sealing a well-bore or piping system comprising using electrokinesis to seal or clog the active fracture leakage path in a well-bore using micelle deposition from crude oil.

In one embodiment, the present invention provides a method, system, and device for sealing a wellbore or piping system by creating a zone or area voltage difference above and below a leak in the wellbore or piping system that uses electro-osmotic flow opposite the direction of the flow of the crude oil leakage.

In one embodiment, the present invention provides a method, system, and device for sealing a wellbore or piping system that uses electro-osmotic flow opposite the direction of the flow of the crude oil leakage.

In one embodiment, the present invention provides a method, system, and device for sealing a wellbore or piping system by creating a voltage difference above and below a leak in the wellbore or piping system that uses an electrophoretic flow of complex and tacky suspended particles in the fracture to plug the effective leakage route of the fracture.

In one embodiment, the present invention provides a method, system, and device for sealing a wellbore or piping that uses an electrophoretic flow of complex and tacky suspended particles in the fracture to plug the effective leakage route of the fracture.

In one embodiment, the present invention provides a method, system, and device for sealing a wellbore or piping system by creating a zone or area voltage difference above and below a leak in the wellbore or piping system that deposits ions in the path of the fracture or porous media to create a blockage in pores and to seal the leakage over time.

In one embodiment, the present invention provides a method, system, and device for sealing a wellbore or piping system that deposits ions in the path of the fracture or porous media to create a blockage in pores and to seal the leakage over time.

In one embodiment, the present invention provides a method, system, and device for sealing a wellbore or piping system by creating a zone or area voltage difference above and below a leak causing ions to absorb in the path of the fracture or porous media to create a blockage in pores and to seal the leakage over time.

In other embodiments, the present invention provides a method, system, and device that causes ions to adsorb in the path of the fracture or porous media to create a blockage in pores and to seal the leakage over time.

In one embodiment, the present invention provides a method, system, and device for sealing a wellbore or piping system by creating a zone or area voltage difference above and below a leak that generates an electrophoretic (DEP) force in wellbore cement fracture through the generation of the non-uniform electric field in the fracture of a variable aperture.

In other embodiments, the present invention provides a method, system, and device wherein neutral or nonpolar particles of crude oil experience DEP forces to reduce or repair the fracture leakage.

In one embodiment, the present invention provides a method, system, and device for sealing a wellbore or piping system by creating a zone or area voltage difference above and below a leak wherein neutral or nonpolar particles of crude oil experience DEP forces to reduce or repair the fracture leakage.

In other embodiments, the present invention provides a method, system, and device for sealing a wellbore wherein the phenomenon of electrokinesis, comprised of electro-osmosis, electrophoresis, and dielectrophoresis generates an opposite force or resistance to the flow from the storage cavern to the wellhead through well flaws, and at the same time, creates particle movement to the fracture from the storage cavern, resulting in a reduction or complete stoppage of the leakage flow.

In other embodiments, the present invention provides a method and device that applies an electric field to prevent crude oil leaking through a wellbore fracture or other piping system.

In other embodiments, the present invention provides a method and device that produce a formation of micelles or particles in a fractured space.

In one embodiment, the present invention provides a method, system, and device for sealing a wellbore or piping system by creating a zone or area voltage difference above and below a leak that promotes the development and/or aggregation of polar crude oil particles on a cement interface.

In other embodiments, the present invention provides a method and device that promote the development and/or aggregation of polar crude oil particles on a cement interface.

In one embodiment, the present invention provides a method, system, and device for sealing a wellbore or piping system by creating a zone or area voltage difference above and below a leak that promotes the development and/or formation of an immobilized sealing layer due to the attraction of counterions available in crude oil resulting in a reduction in the effective aperture or size of a fracture.

In other embodiments, the present invention provides a method and device that promote the development and/or formation of an immobilized sealing layer due to the attraction of counterions available in crude oil resulting in a reduction in the effective aperture or size of a fracture.

In one embodiment, the present invention provides a method, system, and device for sealing a wellbore or piping system by creating a zone or area voltage difference above and below a leak that creates Brownian collisions that release ions from stable positions near the surface causing mobile particles to drift under the action of the electric field inducing an electrokinetic flow which will seal a leakage.

In other embodiments, the present invention provides a method and device that create Brownian collisions that release ions from stable positions near the surface causing mobile particles to drift under the action of the electric field inducing an electrokinetic flow which will seal a leakage.

In other embodiments, the present invention provides a method and device that, based on the chemical composition of crude oil, forms an electro-osmotic flow opposite the direction of the leakage.

In other embodiments, the present invention provides a method and device that generate a dielectrophoretic (DEP) force due to the nonuniform electric field created in the fracture causing neutral particles in the crude oil to seal leakage.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

In the drawings, which are not necessarily drawn to scale, like numerals may describe substantially similar components throughout the several views. Like numerals having different letter suffixes may represent different instances of substantially similar components. The drawings illustrate generally, by way of example, but not by way of limitation, a detailed description of certain embodiments discussed in the present document.

DESCRIPTION OF THE INVENTION

Figure 1B:
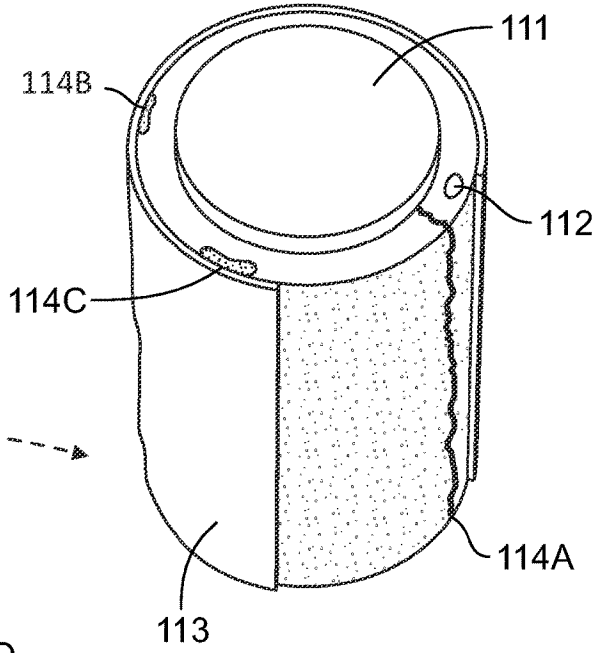
FIG. 1B illustrates fractures in a portion of the wellhead.

Detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a representative basis for teaching one skilled in the art to variously employ the present invention in virtually any appropriately detailed method, structure, or system. Further, the terms and phrases used herein are not intended to be limiting, but rather to provide an understandable description of the invention.

In one embodiment, the present invention provides methods, approaches, and solutions that comprise novel solutions that use electrokinesis for sealing crude oil leakage through smaller fractures. The embodiments of the present invention may be useful in combination with any existing conventional approaches for fractures with a substantially larger aperture.

Electrokinesis is the charged ion movement caused by an applied electric field on a particle that has a net mobile charge. The flow of the liquid is often called electro-osmosis, and the related flow of suspended or dispersed particles or particles dissolved in the liquid is called electrophoresis. A net immobilized surface charge on fluid molecules appears due to adsorption, chemical reactions, and other surface processes, and this charge attracts the counterions of liquid. If the surface charge is significant, a substantial number of counterions will bind ionically to the surface and will be immobilized. Dielectrophoresis is another phenomenon in which a neutral particle gains motion due to the polarization effect in a nonuniform electric field.

Crude oil is a naturally occurring carbonaceous fluid. De-gassed crude oil contains asphaltene, resin, and paraffin in a stable colloidal suspension. Asphaltenes are commonly described as the n-pentane, n-heptane insoluble, benzene-soluble fraction. Asphaltene molecules are comprised of a single aromatic core with about 4 to 10 fused aromatic rings and are known as the heaviest fraction present in crude oil because of its molecular weight. The molecules are also enriched in heteroatoms and peripheral alkyl substituents. The heteroatoms found in asphaltenes are nitrogen, as pyrroles and pyridines; in sulfur, as thiophenes and sulfides; and in oxygen, as phenols, carbonyls, and carboxylic acids. Resins are the next most massive fraction commonly found in crude oil, with a smaller number of fused rings in the aromatic core of the molecule.

The suspended colloid particles in crude oil also are known as micelles. In undisturbed crude oil found in geologic formations, micelles are very stable and are suspended in the solution as microcolloids, which are particles about 3 nm in size. The main structural components of a micelle are one or multiple aromatic sheets of asphaltene molecules. It is believed that resin is also a part of the micelle and acts as a surfactant to stabilize the colloidal suspension.

Micelles are polar due to the presence of polar groups in the molecule structure. The highly polydispersed asphaltene and resin in crude oil can exhibit complex aggregation and flocculation phenomena. The fouling from micelle precipitation in reservoir rocks and pipelines has been reported by several researchers as problematic.

Particle or micelle deposition is common in crude oil. Deposition in cement fractures which reduced the fracture flow to a certain extent has also been observed.

In preferred embodiments, the present invention uses electrokinesis to seal or clog the active fracture leakage path using higher micelle deposition from crude oil. The present invention takes advantage of the underlying physics of micelle formation from crude oil.

A preferred embodiment of the present invention is shown in FIGS. 1A-1D which illustrates the phenomenon of electrokinesis in a leaky wellbore used for underground crude oil storage. System 100 includes self-sealing wellbore 110 in the form of a shaft. The embodiments of the present invention concern repairing damage to a wellbore 110. As shown in FIG. 1B, wellbore 110 may include opening 111 which is surrounded by cement channel 112 which in turn is surrounded by a metal casing 113. As also shown flaws in the wellbore may include a crack in the cement 114A, micro annulus 114B, and corrosion 114C.

For one preferred embodiment of the present invention, when damage has occurred along the wellbore, a zone or area voltage difference 129 is created above and below the damaged section by the anode cathode electrode pair of electrodes 122 and 124. In other embodiments, zone or area of voltage difference 129 may be created along the entire shaft. The voltage difference is designed to charge interface 115. Interface 115 may be in contact with any substance or liquid. In a preferred embodiment interface 115 is the part of cement channel 112 that is in contact with crude oil. In a preferred embodiment, charge interface 115 may be created by the application of a voltage from power source 170 to one or more electrodes 122 and 124, with one serving as the anode and the other as a cathode depending on the direction of applied current.

Figure 1A:
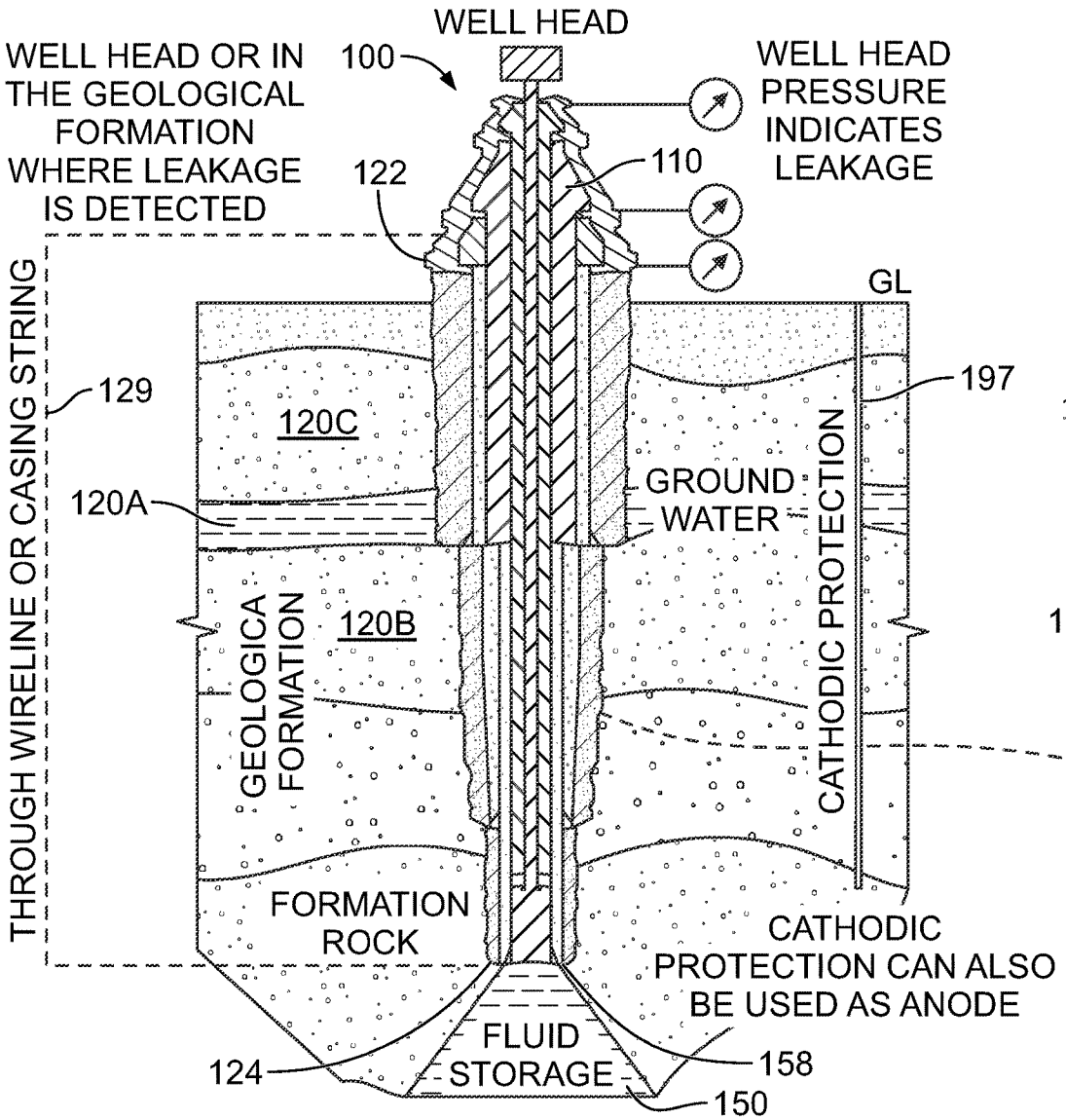
FIG. 1A is a schematic of a first embodiment of the present invention.
Figure 1C:
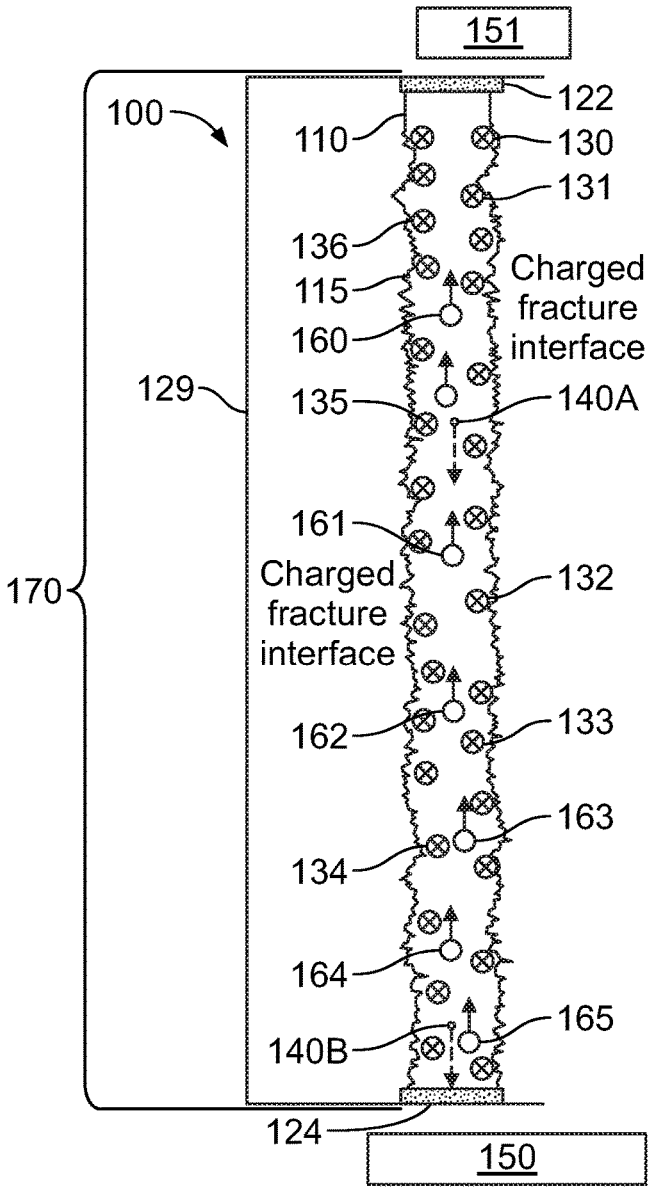
FIG. 1C is a schematic of an embodiment of the present invention.
Figure 1E:
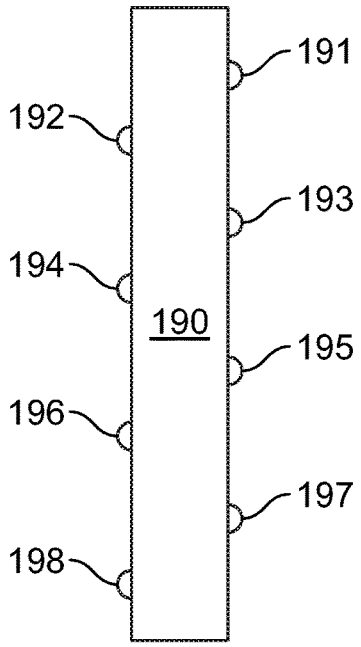
FIG. 1E illustrates another embodiment of the present invention.

In other embodiments of the present invention, as shown in FIG. 1E, wellbore 190 may have a plurality of electrodes 191-198. Each electrode can function as either an anode or cathode or be inactive. This allows for selectivity in tailoring where voltage difference 129 is to occur along the shaft of the wellbore. For example, if a small fracture occurs between electrodes 191 and 192 these two electrodes can be configured to act as the anode and cathode pair to create the desired voltage difference. If, on the other hand, a larger fracture occurs between electrodes 193 and 198, these electrodes can be activated as the anode and cathode pair to repair the fracture. For multiple fractures, multiple anode/cathode pairs may be created. For example, electrodes 196 and 198 may be enabled as an electrode pair to repair a fracture located between these two electrodes while electrodes 191 and 193 may be activated as an anode/cathode pair to repair a fracture located between these two electrodes. This embodiment of the present invention provides the flexibility to create electrode pairs where needed along the wellbore. This, in turn, produces an ability to vary the length of the electric field and location of the electric field as well as enabling multiple electric fields of varying length and location.

While exemplary system 100 is shown having a set of oppositely charged electrodes 122 and 124, the embodiments of the invention further contemplate creating a voltage difference 129 that runs the length of the wellbore by placing an electrode at proximal and distal ends of the shaft of wellbore 110 as shown in FIG. 1A. In other embodiments, oppositely charged electrodes can be later inserted above and below a fracture as needed along the wellbore shaft to create a self-healing wellbore. In other embodiments, the electrodes may be placed along the wellbore through wireline or casing string. In other embodiments, the electrodes may be placed by creating a pathway through areas surrounding the wellbore such as groundwater 120A or geological formations 120B and 120C.

In other embodiments cathodic protection may function as the anode and the wellbore may serve as the cathode.

Figure 1D:
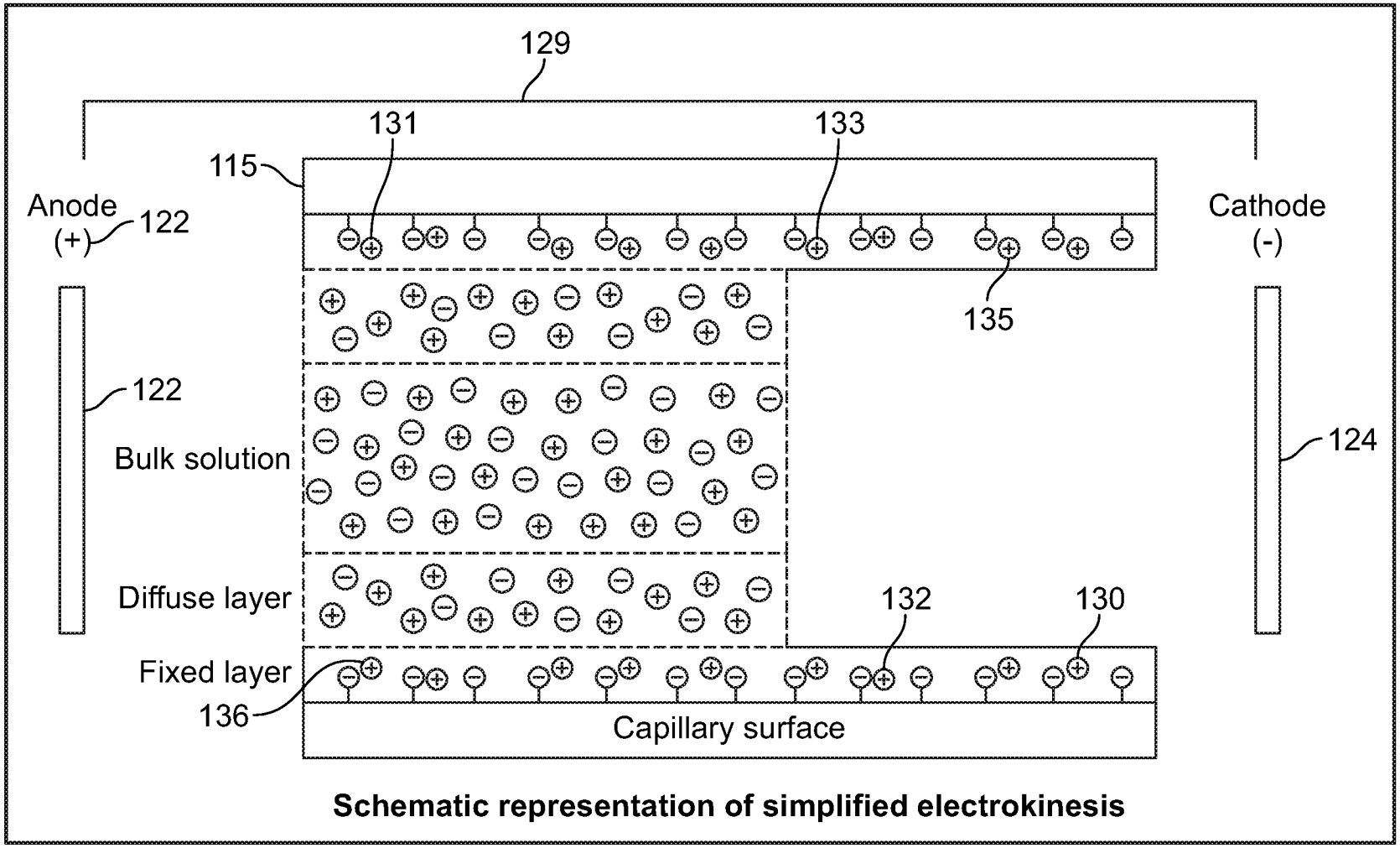
FIG. 1D is a simplified schematic of an embodiment of the present invention.

Crude oil leakage (advective flow) through a cement fracture interface will possess comparatively larger and viscous flocs of micelles due to the applied wellbore pressure gradient. Furthermore, due to the applied electric field created by electrodes 122 and 124, an attraction between the fracture interface 115 (cement) and the polar crude oil particles will develop and will immobilize charges in the liquid. These charges will attract counterions available in the crude oil leaking through the cement fracture. If the surface charge is high, a large number of counterions 130-136 will be immobilized by the creation of an ionic bond to interface 115. As shown in FIG. 1D, interface 115 may have a predetermined charge which is shown as a negative charge although a positive charge may be created as well. This immobilized layer of ions will reduce the effective aperture size and will lower the attractive electric field of the charged interface. As the attractive voltage decreases with the layer thickness and is comparable to the thermal energy of the counterions, Brownian collisions can release ions from stable positions near the surface. These mobile ions of crude oil will drift under the action of the electric field and will induce an electrokinetic flow as they exchange their drift momentum with other molecules of crude oil.

The effect of electrokinesis is significant in microscale fractures. If the nature of chemical compounds in the crude oil permit, an electro-osmotic flow 140A and 140B opposite the direction of the flow of the crude oil leakage from reservoir 150 towards wellhead 151 will be an effective approach to reduce the leakage rate. On the other hand, the electrophoretic flow of complex and tacky suspended particles 160-165 in the fracture will plug the effective leakage route of the fracture and overtime to seal the fracture. The layer of deposited or adsorbed ion in the comparatively smaller flow path of fracture or porous media will create a blockage in smaller pores and over time will seal the leakage.

Due to the pressure difference, crude oil can flow from the storage cavern to the wellhead through well flaws, such as cement fracture. The phenomenon of electrokinesis, comprised of electro-osmosis, electrophoresis, and dielectrophoresis, will generate an opposite force or resistance and at the same time will create the particle movement to the fracture from the storage cavern, resulting in a reduction or complete stoppage of the leakage flow.

Similar to the issue of crude oil fouling encountered in oil and gas industries, paraffin deposition is also likely in the cement fracture due to the temperature variation along the wellbore and will assist in the sealing mechanism.

In other embodiments, a dielectrophoretic (DEP) force also can occur at certain places in wellbore cement fracture due to the generation of the non-uniform electric field in the fracture of a variable aperture. The neutral or nonpolar particles of crude oil will experience DEP forces, which, with the controlled arrangement, can also help to reduce or repair the fracture leakage. DEP force depends on the particle volume, the dielectric permittivity of crude oil, and the gradient of the field intensity.

Figure 2:
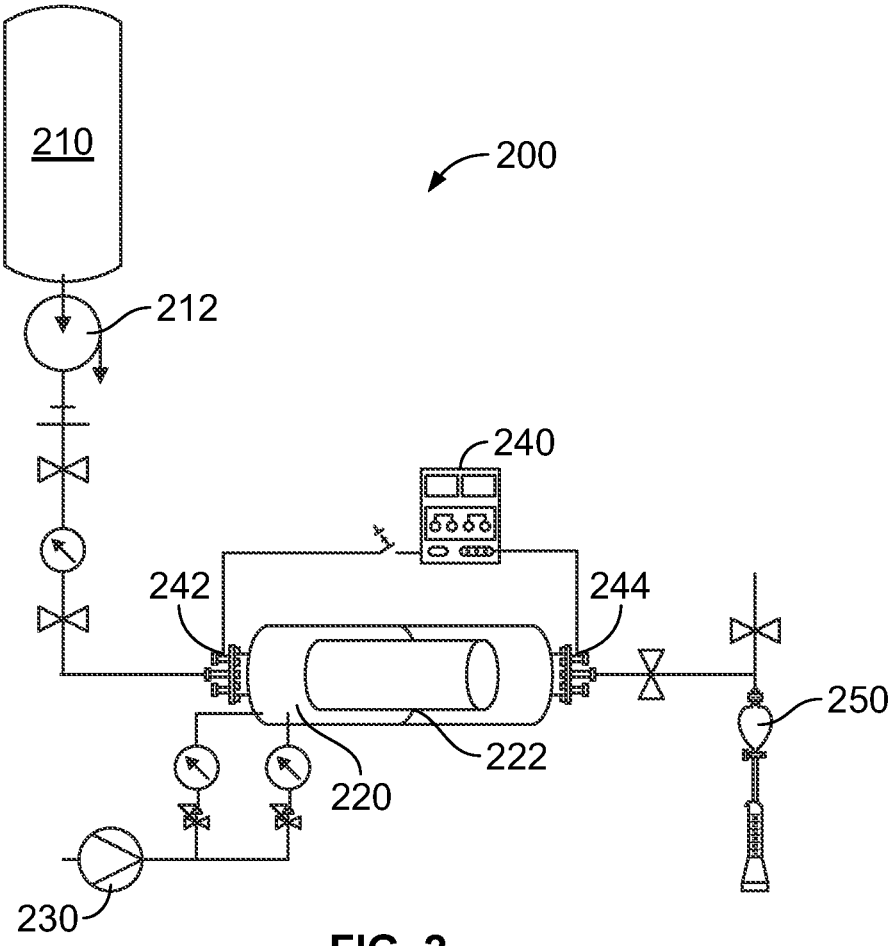
FIG. 2 illustrates a schematic of the test configuration for the embodiments of the present invention.

A schematic of an embodiment of the present invention used to create test samples is shown in FIG. 2. As shown, system 200 includes reservoir 210, pump 212, pressure vessel 220, specimen or core holder 222, and pump 230 for exerting confining radial and axial stress around the specimen. Also provided is power supply 240 which supplies a voltage to opposing located electrodes 242 and 244. Electrodes 242 and 244 are located upstream and downstream from flow from reservoir 210 through pressure vessel 222 collection system 250.

Representative wellbore cement samples were prepared from cement paste consisting of API Class G Portland cement, silica fume (BASF Rheomac SF100), plasticizer (BASF Glenium 3030), and distilled water. The mix design was in accordance with ASTM C305-14. To create flaws (single fracture) in the specimen, an axial fracture was created in the cement samples, making use of the Brazilian tensile splitting method. Steady-state flow measurements were made using a specially designed permeameter system with confining or external stress of 13.8 MPa, which approximately corresponds to the expected geostatic stress at a depth of about 700 m. A variable DC power supply (BK Precision Model 1601) was used to create a voltage difference between the electrodes, connected to the upstream and downstream of the flow that occurred in the permeameter.

The permeability to liquid can be found directly from Darcy's law using measured flow rates and pressures obtained in a steady-state flow test. The liquid permeability can be interpreted as a hydraulic aperture using the cubic law. The estimated hydraulic aperture of the specimen was about 15 μm. Subsequently, the voltage difference (15 V DC) was applied to the steady-state crude oil flow in the system. It was found that at a constant pressure head, the flow rate decreased over time, and about 60 minutes later, the flow decreased below the resolution of the flow measurements. This indicated that electrokinesis can be a significant mechanism to reduce or stop crude oil leakage through a fracture.

Figure 3:
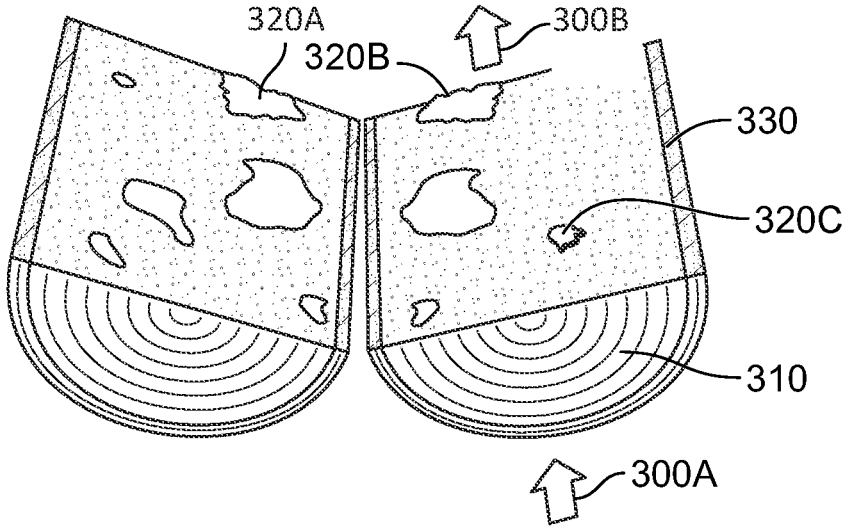
FIG. 3 illustrates micelle aggregation in the fracture interface after electrokinesis.
Figure 4A:
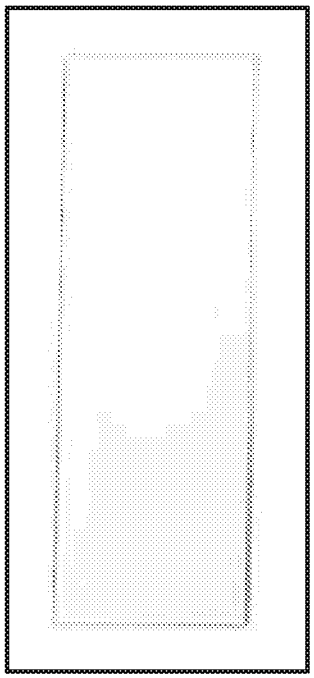
FIG. 4A illustrates undisturbed crude oil with stable micelles suspended as microcolloids.
Figure 4B:
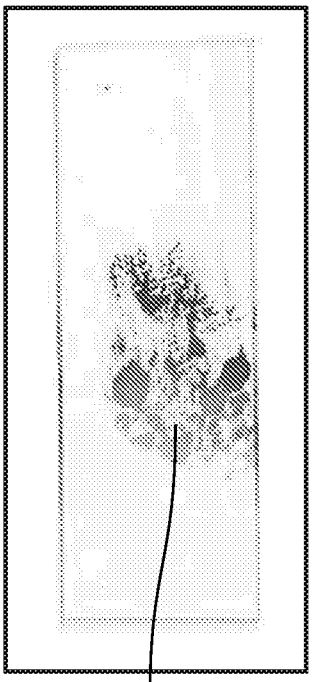
FIG. 4B illustrates the initial stage of micelles aggregation.
Figure 4C:
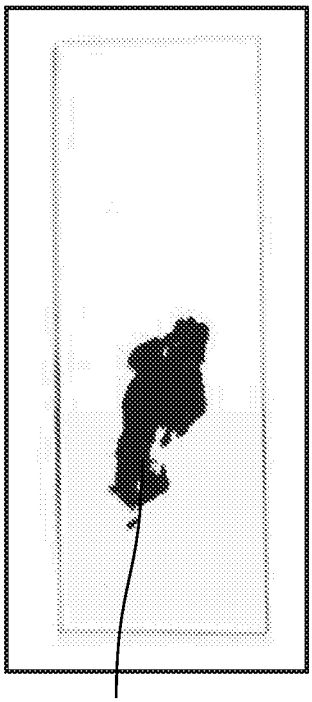
FIG. 4C illustrates a comparatively higher level of micelle aggregation observed in cement fracture after electrokinesis.

Post-test results of the cement fracture are presented in FIG. 3, showing the layers of adsorbed aggregated micelles or heteroatomic crude oil particles in the fracture interface. Specifically as shown, in the direction of flow 300A-300B, the layers include heart cement paste, deposited adsorbed aggregated micelles or heteroatomic crude oil particles 320A-C, and solid shore 70A rubber 330. FIG. 4A illustrates micelles in undisturbed crude oil. FIG. 4B illustrates the initial stage of micelle aggregation 405 in crude oil due to elevated fluid pressure within the fracture. FIG. 4C illustrates a relatively higher level of micelle aggregation after electrokinesis. The dark coloration of the tacky material 410 in FIG. 4C indicates that electrokinesis in a fracture with crude oil can noticeably increase the level of micelle aggregation and flocculation.

Crude oil with suspended particles can leak through existing wellbore cement fractures of different apertures and roughness. The conventional fracture repair methods, such as fine cement or polymer injection, might not be efficient because of the variation in penetrability through the leakage path, mostly starting from the casing shoe 158, which may function as an electrode for system 100.

However, electrokinesis can be easily and effectively used for multiple fractures of different aperture sizes and roughness by appropriately adjusting the voltage difference. The installation would be simple and straightforward for wellbores with steel casing by locating electrodes upstream and downstream from the flow. The technique is expected to work for detectable and undetectable fractures.

Additionally, the technique will be applied for active leakage with pressure-driven or advective fracture flow, where the deposition of clogging would be aided by cavern pressure. Therefore, the voltage requirement for controlling the substantially small amount of fluid movement in the fractures would likely not be significant.

The methods and systems of the present invention can also be used collectively with conventional repair methods to avoid the requirement of high-injection pressure. This application might reduce the galvanic corrosion of casing results from the voltage difference between internal casing strings.

In other applications, the embodiments of the present invention may be useful for other wellbore systems used for different types of underground liquid storage.

It is to be understood that both the foregoing general description and the following detailed description are exemplary and explanatory only and are not restrictive of the invention, as claimed. Moreover, while the foregoing written description enables one of ordinary skill to make and use what is considered presently to be the best mode thereof, those of ordinary skill will understand and appreciate the existence of variations, combinations, and equivalents of the specific embodiment, method, and examples herein. The disclosure should therefore not be limited by the above-described embodiments, methods, and examples, but by all embodiments and methods within the scope and spirit of the disclosure.

What is claimed is:

1. A method of repairing one or more fractures in cement in a wellbore, the wellbore having a direction of flow from a reservoir to a wellhead, the method comprising: providing a plurality of electrodes, pairing the plurality of electrodes to form one or more anode cathode pairs, applying a current to said one or more anode cathode pairs and thereby creating one or more electric fields that (i) produce an attraction between the one or more fractures and micelles from crude oil flowing in the wellbore, and (ii) induce flow of said micelles into the one or more fractures by electrokinesis; thereby depositing the micelles in, and repairing, the one or more fractures.

2. The method of claim 1 wherein the length of the one or more electric fields and location of the one or more electric fields is varied by varying the pairing of the plurality of electrodes.

3. The method of claim 1 wherein the one or more anode cathode pairs are formed along the length of the wellbore.

4. The method of claim 1 wherein the length and location of the one or more created electric fields vary along the wellbore.

5. The method of claim 1 wherein at least one of said electrodes is placed along the wellbore through a wireline.

6. The method of claim 1 wherein at least one of said electrodes is placed along the wellbore through a casing string.

7. The method of claim 1 wherein at least one of said electrodes is placed along the wellbore by creating a pathway through an area surrounding the wellbore.

8. The method of claim 7 wherein at least one of said electrodes is placed along the wellbore by creating a pathway through groundwater.

9. The method of claim 7 wherein at least one of said electrodes is placed along the wellbore by creating a pathway through a geological formation.

10. The method of claim 7 wherein at least one anode of said one or more anode cathode pairs is a cathodic protection of said wellbore.

11. A method of repairing one or more fractures in cement in a wellbore, the wellbore having a direction of flow from a reservoir to a wellhead, the method comprising: providing a plurality of electrodes, pairing the plurality of electrodes to form one or more anode cathode pairs, applying a current to said one or more anode cathode pairs and thereby creating one or more electric fields that (i) produce an attraction between the one or more fractures and micelles from crude oil flowing in the wellbore, (ii) induce movement of the micelles in the direction of flow in the wellbore by electrophoresis and, (iii) produce electroosmotic flow of liquid in a direction opposite to the direction of flow in the wellbore; thereby depositing the micelles in, and repairing, the one or more fractures.

* * * * *